United States Patent [19]

Wu

[11] Patent Number: 4,960,212

[45] Date of Patent: Oct. 2, 1990

[54] GOLF CLUB REST FOR GOLF BAG

[76] Inventor: Chun S. Wu, No. 23, Shin Yih South Rd., Tainan, Taiwan

[21] Appl. No.: 413,031

[22] Filed: Sep. 27, 1989

[51] Int. Cl.[5] ..... A47F 7/00

[52] U.S. Cl. ..... 211/70.2; 211/71; 211/120

[58] Field of Search ..... 211/70.2, 89, 120, 13, 211/69.1, 70.6, 70.7, 60.1, 71; 248/95, 99, 100, 101

[56] References Cited

U.S. PATENT DOCUMENTS

| | | | |
|---|---|---|---|
| 2,621,799 | 12/1952 | Wilson | 211/70.2 |
| 2,753,189 | 7/1956 | Conroy et al. | 211/70.2 X |
| 3,503,518 | 3/1970 | Black | 211/70.2 |
| 4,181,167 | 1/1980 | Ret | 211/70.2 X |

*Primary Examiner*—Alvin C. Chin-Shue
*Assistant Examiner*—Sarah A. Lechok
*Attorney, Agent, or Firm*—Varndell Legal Group

[57] ABSTRACT

A golf club support includes a main frame and an auxiliary frame for attachment to a golf bag. The main frame has a plurality of dividers defining therebetween spaces for retaining golf clubs therein. The dividers have relatively thin curved sidewall portions which provide elastic resilience for firmly retaining golf clubs in place. The auxiliary frame also includes dividers defining spaces for retaining golf clubs. The auxiliary frame is rotatable from a position inside the golf bag to a position disposed outside of the bag.

3 Claims, 3 Drawing Sheets

GOLF CLUB REST FOR GOLF BAG

BACKGROUND OF THE INVENTION

Golf is one of the most popular recreational sports in the world. When playing a round of golf, different golf clubs are utilized for making different types of shots. Caddies are often employed for carrying the golf bag and selecting the proper club for a particular shot. However, many golfers do not employ caddies, and are required to make their own club selection. Most golf bags are of very simple construction such that the golf clubs are not arranged in an orderly manner and, furthermore, the clubs are constantly colliding with one another thereby causing damage to the golf clubs.

It is therefore, the main object of the present invention to provide a golf club support for a golf bag to enable different golf clubs to be properly arranged in a golf bag for easy identification and selection.

It is another object of the present invention to provide a golf club support for a golf bag which protects the golf clubs form damage due to collision with each other.

It is yet a further object of the present invention to provide a golf club support for a golf bag which is inexpensive to manufacture, easy to assemble, and durable and practical in use.

Figure 3:
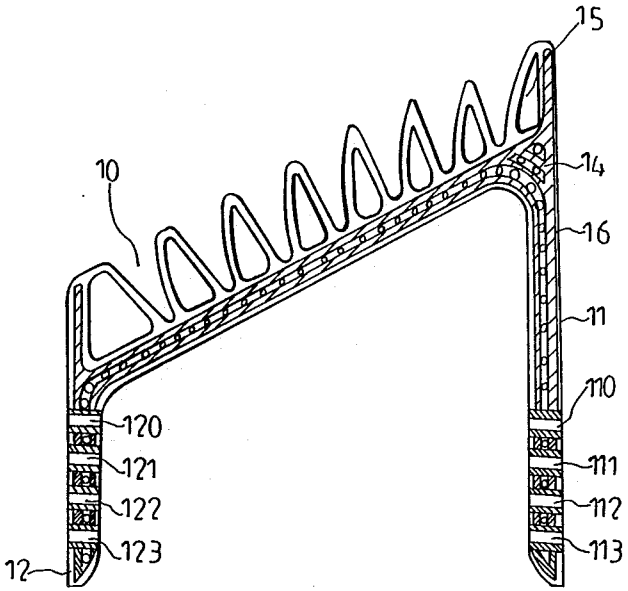
FIG. 3 is a sectional view of the main frame of the present invention.
Figure 1:
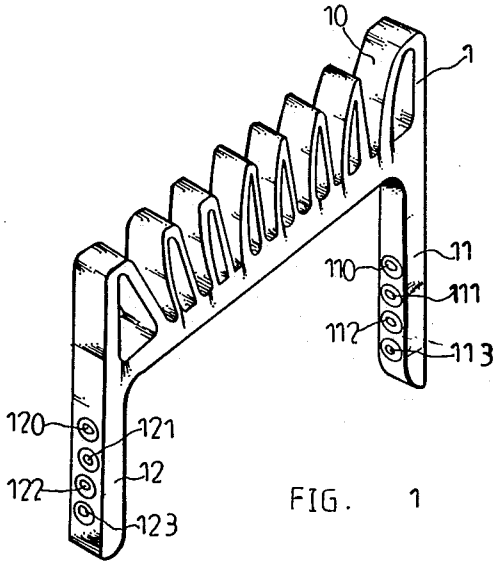
FIG. 1 is a perspective view of the main frame of the present invention.
Figure 2:
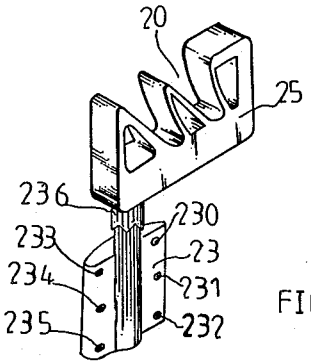
FIG. 2 is a perspective view of the movable auxiliary frame of the present invention.

DETAILED DESCRIPTION OF THE PREFERRED EMBODIMENT;

Referring now to FIGS. 1-3 of the drawings, there is shown a golf club support embodying the present invention and comprising a main frame generally designated by the numeral 1 and a movable auxiliary frame generally designated by the numeral 2.

The main frame 1 includes an integral transverse rack 10 including a plurality of dividers 15 of generally triangular shape defining therebetween seven loading spaces 10*a*, the rack being integral with a long support member 11 and a short support member 12 disposed at opposite lateral sides thereof. Support members 11 and 12 have four holes 110, 111, 11 and 113, and 120, 121, 122 and 123 respectively formed therein through which screw means are inserted to secure the main frame 1 to a golf bag 30. The movable auxiliary frame 2 comprises a rack 25, which defines therein two loading spaces 20 for supporting golf clubs; and a positioning plate 23 is provided with two rows of holes 230,231 and 232, and 233,234 and 235 at the sides thereof through which screw means are inserted to secure the movable auxiliary frame 2 to the golf bag 30.

Figure 4:
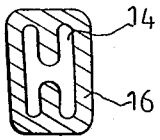
FIG. 4 is a cross-sectional view of the main frame of the present invention.

Referring to FIGS. 3 and 4, the main frame 1 is made of rigid plastic 14 covered with soft PVC leather 16. Each of the dividers 15 of the rack 10 of the main frame 1 comprises a thicker linear side wall and a thinner curved sidewall which provides high elastic resilience to let golf clubs be firmly retained in place when they are set in the loading spaces 10*a*.

Figure 6:
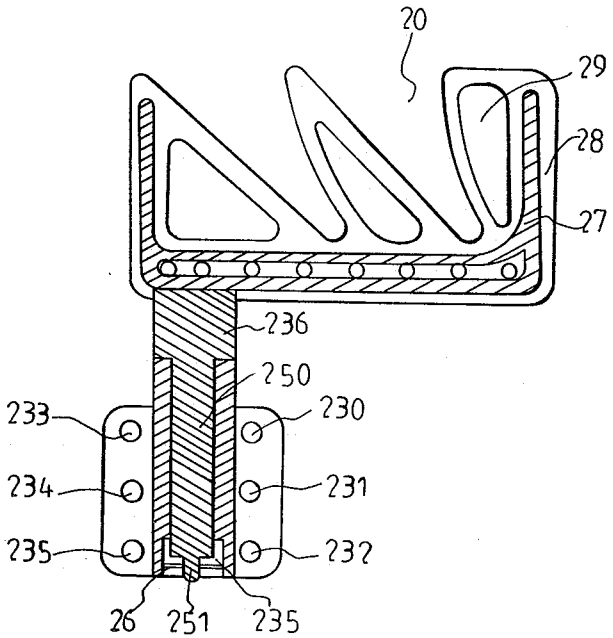
FIG. 6 is a sectional assembly view of the movable auxiliary frame of the present invention.
Figure 5:
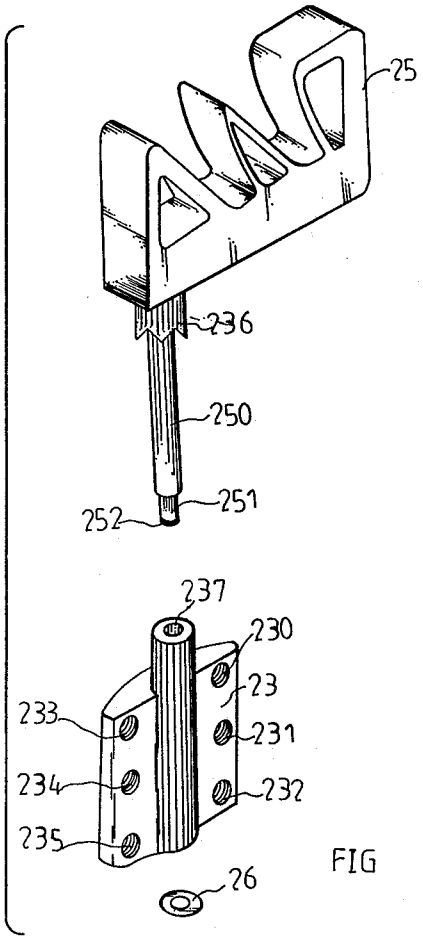
FIG. 5 is a perspective exploded view of the movable auxiliary frame of the present invention.

Referring to FIG. 5, the movable auxiliary frame 2 includes a rack 25, a positioning plate 23 and a retainer ring 26. The rack 25 includes a stepped circular rod 250 extending downwardly from its bottom at one lateral side thereof. The circular rod 250 has a reduced bottom end 251 having a circular groove 252 formed therearound. The positioning plate 23 includes a tubular portion in the middle defining therein a stepped bore 237, i.e. the positioning plate 23 has a wider inner diameter at the bottom end and a narrower inner diameter at the upper portion. As shown in FIG. 6, when the stepped circular rod 250 of the rack 25 is inserted into the bore 237 of the positioning plate 23, the retainer ring 26 is mounted in the circular groove 252 on the stepped circular rod 250 to limit upward movement of rod 250 relative to plate 23. The rack 25 of the movable auxiliary frame 2 is also made of rigid plastic 27 covered with soft PVC leather 28, which rack 25 includes three dividers 29 defining therebetween two loading spaces 20. Similar to the structure of the rack 10 of the main frame 1, the construction of rack 25 provides high elastic resilience to firmly retain any club set therein. According to the present invention, the rack 25 is connected with the stepped circular rod 250 by means of a crown stay 236 which permits the rack 25 to change angular position relative to the positioning plate 23 within a circle through a 4-step movement, i.e. one step of movement equal to an angle of 90°.

Figure 8:
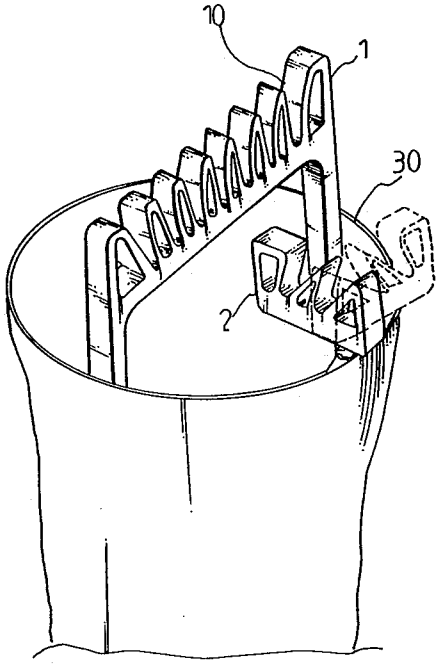
FIG. 8 is a schematic drawing illustrating the manner in which the movable auxiliary frame can be moved outwardly to a different position.
Figure 7:
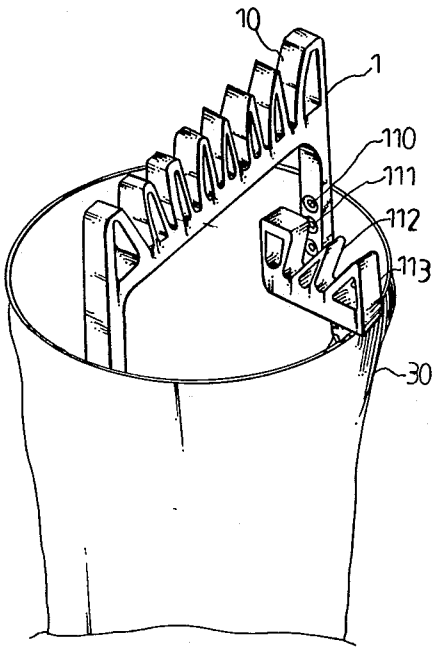
FIG. 7 is a schematic view of the present invention wherein the golf club support is mounted in and connected to a regular golf bag for supporting golf clubs.

Referring to FIGS. 7 and 8, when in use, the main frame 1 is placed in a golf bag 30 and fixedly connected thereto by means of screw means through the holes 110, 111, 112, 113, 120, 121, 122 and 123 of the rod supports 11 and 12, and the movable auxiliary frame 2 is positioned perpendicular to the main frame 1 and fixedly connected to the golf bag 30 by means of screw means through the holes 230, 231, 232, 233, 234, and 235 of the positioning plate 23. Therefore, seven golf clubs of different size can be respectively set in the seven loading spaces 10*a* of the rack 10 of the main frame 1 in a proper order according to size. Further, the movable auxiliary frame 2 may be turned outward to the broken line position so that the rack 25 is disposed outside the golf bag for convenient support of golf clubs.

Thus, it can be seen from the foregoing description that the golf club support of the present invention is especially easy to assemble and is constructed from a minimum number of component parts to insure economy of manufacture and durability in use. The height of the main frame 1 and the position of the movable auxiliary frame in a golf bag can be conveniently adjusted.

What is claimed is:

1. A golf club support for a golf bag comprising in combination, a golf bag having an open end, a main frame supported at the open end of the golf bag, said main frame comprising a plurality of dividers defining spaces therebetween for receiving golf clubs, and an auxiliary frame supported at the open end of the golf bag, said auxiliary frame also having a plurality of dividers defining spaces therebetween for receiving golf clubs, said auxiliary frame being rotatable with respect to said golf bag so as to be selectively movable between operative positions inside and outside said golf bag.

2. A golf club support as defined in claim 1, wherein each of said dividers includes a linear side wall and a curved side wall, said curved side wall being thinner than said linear wall so as to provide resilient curved sidewall portions to firmly retain golf clubs in place within said spaces.

3. A golf club support for a golf bag wherein said support is made of rigid plastic covered with soft PVC leather, a main frame connected to the golf bag and comprising a main rack having support portions at opposite ends thereof, one of said support portions being shorter than the other one, said support portions having holes therethrough for receiving screws to fixedly connect the main frame to the golf bag and hold the golf bag open, said main rack including a plurality of hollow generally triangular dividers defining spaces for receiving golf clubs therebetween, each of said dividers having a linear side wall and a curved side wall, said side curved wall being thinner than said linear wall to provide a resilient curved side wall, a movable auxiliary frame, said auxiliary frame including a plurality of generally triangular dividers defining spaces therebetween for receiving golf clubs, a plate for supporting said auxiliary rack, said plate including a rod portion having a stepped bore formed therethrough, a stepped rod connected to said auxiliary frame and being disposed within said stepped bore of said rod portion, said auxiliary frame being rotatable with respect to said plate through a 4-step movement wherein each step equals about 90°, said rod having a circular groove at the bottom thereof, and a retaining ring mounted in said groove for limiting upward movement of said rod with respect to said rod portion.

* * * * *